US005476407A

United States Patent [19]

Hall, Jr.

[11] Patent Number: 5,476,407

[45] Date of Patent: Dec. 19, 1995

[54] CHILD'S TOY FOR PLAYING STORE CHECKER

[76] Inventor: Alton L. Hall, Jr., 5256 E. Costilla Dr., Littleton, Colo. 80112

[21] Appl. No.: 248,455

[22] Filed: May 24, 1994

[51] Int. Cl.[6] ..... A63H 5/00

[52] U.S. Cl. ..... 446/397; 446/485; 446/491; 446/489

[58] Field of Search ..... 446/143, 397, 446/479, 484, 485, 406, 491, 489; 434/219; 186/59, 61

[56] References Cited

U.S. PATENT DOCUMENTS

| | | | |
|---|---|---|---|
| 2,664,665 | 1/1954 | Rozenoff | 446/397 |
| 3,654,710 | 4/1972 | Banard | 446/485 |
| 4,071,740 | 1/1978 | Gogulski | 186/61 |
| 4,138,000 | 2/1979 | Hartup | 186/59 |
| 4,282,674 | 8/1981 | Hanson | 446/143 |
| 4,307,534 | 12/1981 | Tomita | 446/143 |
| 4,321,768 | 3/1982 | Engelhardt | 446/397 |
| 4,973,287 | 11/1990 | Martin | 446/143 |
| 5,149,947 | 9/1992 | Collins | 186/59 |

FOREIGN PATENT DOCUMENTS

| | | | |
|---|---|---|---|
| 949150 | 9/1956 | Germany | 446/406 |

OTHER PUBLICATIONS

Spectra–Physics, Freedom Plus Barcode Scanner, 1990 brochure.

*Primary Examiner*—Robert A. Hafer
*Assistant Examiner*—Jeffrey D. Carlson
*Attorney, Agent, or Firm*—Edwin H. Crabtree; Donald W. Margolis; Ramon L. Pizawo

[57] ABSTRACT

A child's toy for playing checker at a check out stand used in retail stores and the like. An on/off switch is connected to a battery power source inside a housing. The power source, via electrical leads, is connected to a red and green light mounted in the top portion of the housing. An item switch, which is temporarily engaged by different play items to be checked, is also mounted in the top portion of the housing and electrically connected to the power source and the red and green lights. When the on/off switch is turned "on", the red light is turned "on". When a child places a play item to be checked against the item switch in the top portion of the housing, the item switch opens electrical lead to the red light turning it "off" and at the same time closes the electrical lead to the green light turning it "on". The toy can also include a buzzer which sounds when the green light is turned "on". When the play item being checked is removed from engagement with the item switch, the green light is again turned "off" and the red light is turned "on". In this manner the child can pretend to play checker at a retail outlet.

20 Claims, 2 Drawing Sheets

CHILD'

BACKGROUND OF INVENTION (a) Field of the Invention

This invention relates to a child's toy and more particularly, but not by way of limitation, to a child's toy used by a child with play items for playing a checker at a check out stand. The check out stand similar to those used in retail stores and other stores where merchandise is purchased.

(b) Discussion of Prior Art

Heretofore there have been a variety of different types of toy cash registers and check out stations. In U.S. Pat. 4,973,287 to Martin, a toy check out station which simulates the action of a real check out station is disclosed. The invention described in this patent includes a field generator with discs for identifying individual items with bar codes. In U.S. Pat. Nos. 4,282,674 to Hansen et al. and 4,195,423 to Iwao, two different types of toy cash registers for young children are disclosed. These patents show indicia display windows for teaching children how to operate a cash register and make change.

In U.S. Pat. Nos. 3,562,705 to Paris and 2,799,854 to Barnes portable traffic lights are disclosed that can be used manually in a case of an emergency are described. These patents have value as to the discussion on how traffic lights are wired for switching from green to yellow to red and then back to green. None of the above mentioned patents disclose the unique features and structure of the subject invention wherein a child using the toy can play checker at a check out stand. The invention simulating a bar code reader used for scanning and itemizing various items to be checked.

SUMMARY OF THE INVENTION

In view of the foregoing, it is an object of the present invention to provide a toy for a child so that the child can play a checker at a check out stand similar to bar code readers seen by a child in retail outlets and the like.

Another object of the invention is to provide a hands-on toy wherein the child can hold the toy in his or her hand or place the toy on a table or stand for playing checker and passing various play items across the checker to imitate being an adult checker at a check out stand.

Still another object of the subject toy is when the play item is properly placed against an item switch in the top of the housing of the toy, a red light is turned "off" and a green light is turned "on" and a buzzer is sounded indicating an item has been properly checked.

A further object of the invention is the toy includes a total switch in the toy housing which can be pushed when one or more items have been checked. When the total switch is pushed, a "THANK YOU" light is illuminated and a buzzer is sounded.

Another object of the toy checker is the addition of an electrical counter connected to the item switch for counting the items checked by the child thereby helping teach a small child how to count.

Still a further object of the invention is the including of a scanning gun with a light which can be attached to the toy. The scanning gun can also be used to simulate scanning the play items being checked. When a trigger is pulled on the scanning gun, the light on the gun is illuminated and a buzzer is sounded.

Yet another object of the invention is the toy checker and scanning gun can be used in conjunction with a small table or stand wherein the table or stand can be used to imitate a check out stand. The table or stand can include a drawer for holding play money for making change. In this manner a child can learn to count items, operate a simple electrical device, and learn to make correct change with money for the overall education of the child and his or her playmates.

The subject invention provides a child's toy for playing checker at a check out stand used in retail stores and the like. The child's toy includes a housing which can be hand held or placed on a stand or a table. The housing includes a top portion, a bottom portion and side portions with an on/off switch mounted in one of the side portions. The on/off switch is connected to a battery power source inside the housing. The power source is connected to a red and a green light mounted in the top portion of the housing. An item switch, which is temporarily engaged by different play items to be checked, is also mounted in the top portion of the housing and electrically connected to the power source and the red and green lights. When the on/off switch is turned "on", the red light is turned "on". When a child places a play item to be checked against the item switch in the top portion of the housing, the item switch opens the electrical lead to the red light turning it "off" and at the same time closes the electrical lead to the green light turning it "on". The toy can also include a buzzer which sounds when the green light is turned "on". When the play item being checked is removed from engagement with the item switch, the green light is again turned "off" and the red light is turned "on". In this manner the child can pretend to play checker at a retail outlet.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
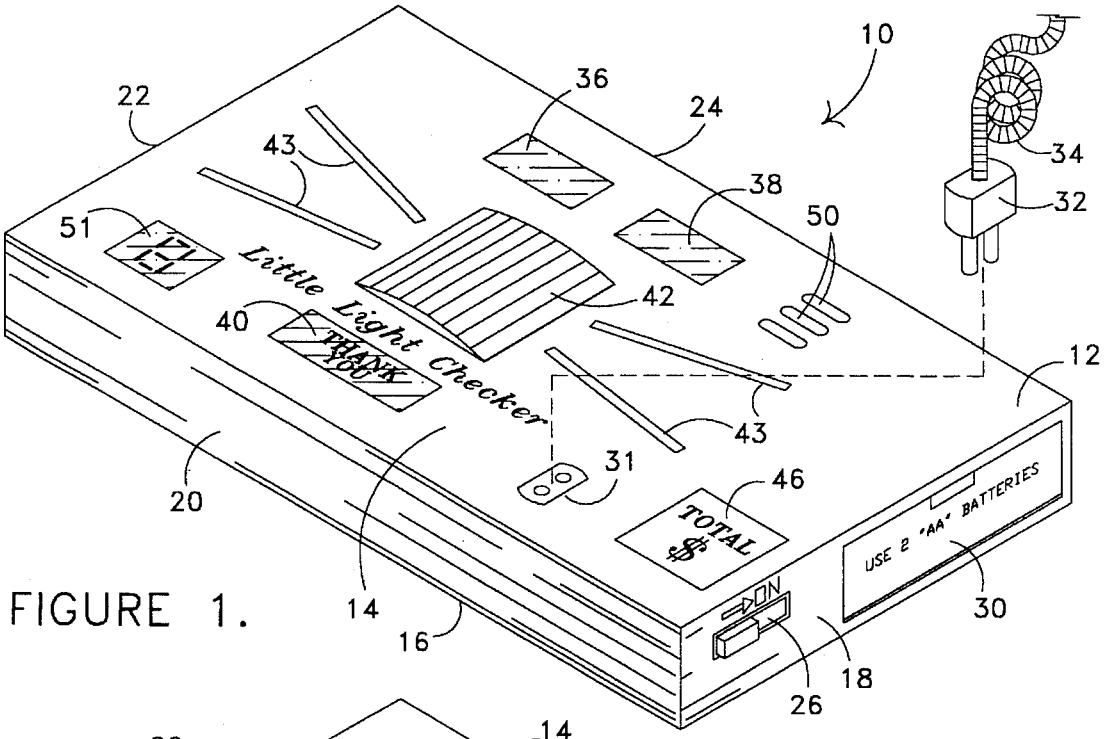
FIG. 1 illustrates a perspective view of the toy for playing checker.

In FIG. 1, a perspective view of the child's toy is illustrated having general reference numeral 10. The toy 10 includes a housing 12 having a top portion 14, a bottom portion 16, and side portions 18, 20, 22 and 24. In the side portion 18 is mounted an on/off switch 26 which is electrically connected to a power source such a batteries 28, shown in FIG. 2. The batteries 28 are received inside a battery door 30 in the side portion 18.

In the top portion 14 is an electrical socket 31 which is used for receiving an electrical plug 32 with cord 34. The cord 34 is attached to a gun scanner which is discussed under FIG. 4. Also, in the top portion 14 of the housing 12 is red light window 36, a green light window 38, a "THANK YOU" window 40, an item switch cover 42 disposed on top of an item switch 44 shown in FIG. 2, item guides 43 disposed on opposite sides of the item switch 44, a "TOTAL" switch cover 46 disposed on top of a total switch 48 shown in FIG. 2 and a sound opening 50 disposed above a buzzer 52 shown in FIG. 2. It should be noted that when the child is checking play items by engaging the item switch cover 42 and item switch 44, the play items may be moved toward the cover 42 from the left or from the right for turning on the switch 44.

Figure 2:
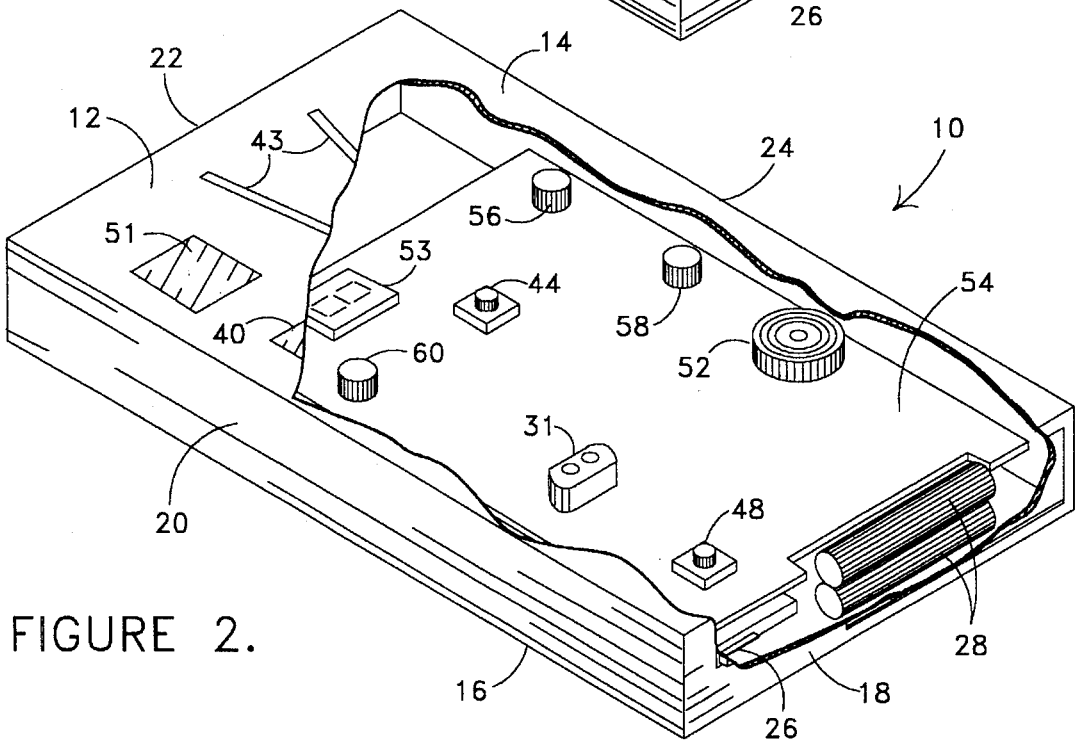
FIG. 2 illustrates a perspective view of the toy as shown in FIG. 1 wherein a portion of the toy housing is cut away to exposed the electrical circuit board along with the lights, buzzer and switches.

Further, the toy 10 can also include a counter window 51 in the top portion 12 and disposed above an electronic counter 53 shown in FIG. 2. The electronic counter 53 in the drawings indicates that "8" items have been counted by the child playing with the toy 10.

In FIG. 2, part of the top portion 14 has been cut away to expose the internal workings of the toy 10. In this view, a printed circuit board 54 is shown with the switches 44 and 48 mounted thereon along with the buzzer 52. Also shown mounted on the circuit board 54 are red light 56 mounted under red light window 36 and green light 58 mounted under green light window 38 along with another light 60 mounted under the "THANK YOU" window 40. Further the plug socket 31 is shown mounted on the circuit board 54.

Figure 3:
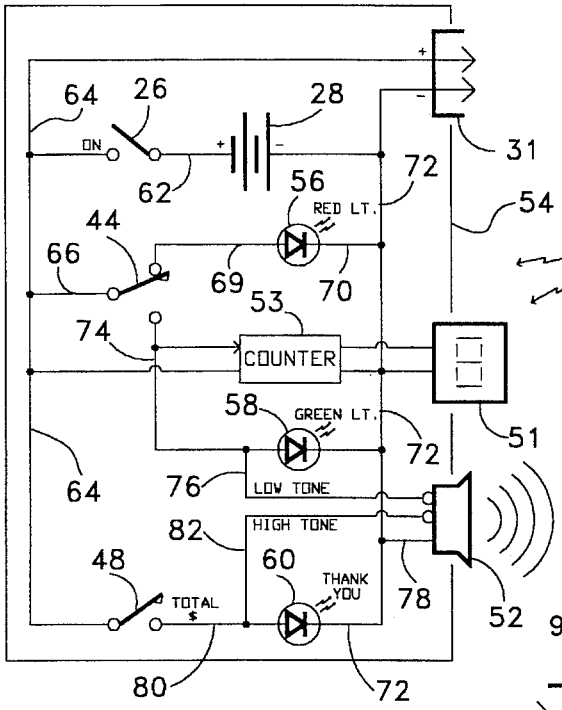
FIG. 3 shows an electrical schematic of the wiring of the child's toy.

FIG. 3 illustrates an electrical schematic of the toy 10 wherein the on/off switch 26 is wired to the battery power source 28 via electrical leads 62 and 64. The lead 64 is connected to the item switch 44 via lead 66. The switch 44 is held in a normally closed position and connected to red light 56 via lead 69. The red light 56 is connected to the power source 28 via return leads 70 and 72. In this manner, when the on/off switch 26 is turned "on" the red light 56 is also turned "on".

When the item switch 44 is temporarily opened due to an engagement with a play item, the item switch 44 disconnects the red light 56 turning the red light "off" and the item switch 44 makes contact with lead 74 turning the green light "on". At the same time the green light is turned "on", the counter 53 is energized and each play item engaged by the item switch 44 is counted. Also, when the green light is turned "on", a low tone of the buzzer 52 is actuated via lead 76. The buzzer 52 is connected to the power source 28 via return leads 78 and 72.

When the child wishes to play the totaling of the play items checked by the toy 10, he or she can press the top of the total window 46 which engages the total switch 48 closing the switch 48 to lead 80 thereby turning the THANK YOU light 60 "on". At this time via lead 82 the buzzer 52 is energized and a high tone is sounded.

Figure 4:
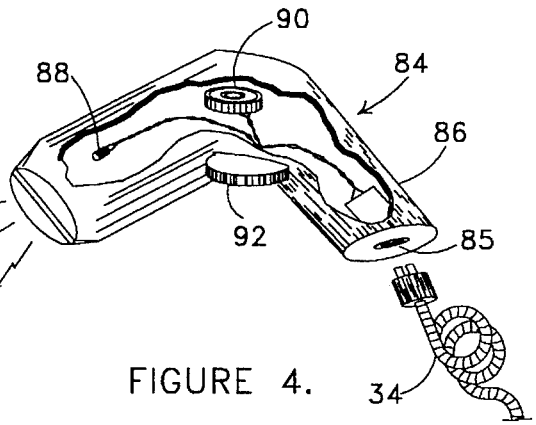
FIG. 4 illustrates a perspective view of a gun scanner which can be plugged into the toy housing and used for scanning play items when using the subject toy.

In FIG. 4, an additional feature of the toy 10 is the use of a play item scanning gun shown in a perspective view and having a general reference numeral 84. The scanning gun 84 may be powered by individual batteries, not shown in the drawings, when being used independently of the toy 10 or connected to the toy 10 via the electrical cord 34 engaging an electrical plug 85 for receiving power from the power source 28. Using the electrical cord 34, the scanning gun 84 can be used with the counter 53 in the toy 10 for both scanning and counting various play items. The scanning gun 84 includes a gun housing 86 which has been cut away to expose a gun light 88, a gun buzzer 90 and a gun trigger switch 92. When the child uses the scanning gun 84 for checking various play items, he or she can pull the gun trigger switch 92 and at that time the gun light 88 is turned "on" and the buzzer 90 is sounded.

Figure 5:
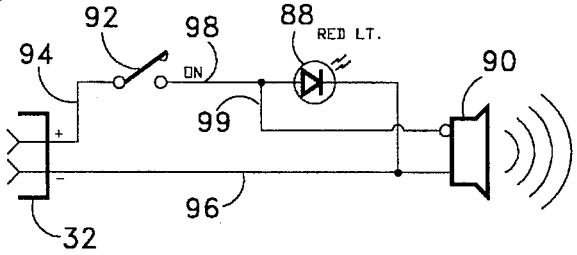
FIG. 5 shows an electrical schematic of the wiring of the child's gun scanner.

In FIG. 5, a schematic of the electrical circuitry of the scanning gun 84 is shown wherein when the cord 34 is connected to the plug 85 power is applied to the gun 84 via leads 94 and 96. When the gun trigger switch 92 is temporarily closed, power is supplied through lead 98 to lead 99 completing the circuit for turning the light 88 "on" and sounding the gun buzzer 90. When the child plays with the scanning gun 84, it is obvious that he or she can pretend to be itemizing items similar to bar code scanning guns used by adults at retail stores and the like.

Figure 6:
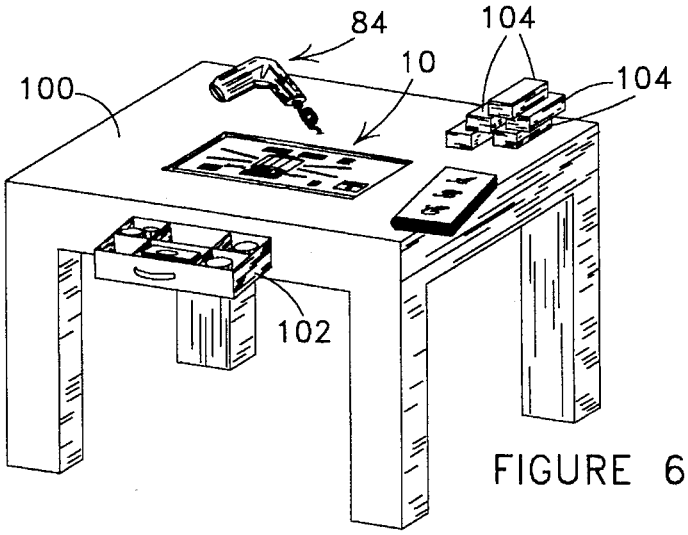
FIG. 6 is perspective view of a little table with change drawer for use with the child's toy when playing checker and canning and itemizing play items placed on the table.

In FIG. 6, a perspective view of the toy checker 10 is shown with the scanning gun 84 attached and placed on top of a small child's table 100. The table 100 includes a drawer 102 for holding play money and coins so that the child when playing checker at a check out station can make change for a playmate and in turn learn to make change and begin to learn how money is used in the buying and selling of goods. Also shown in this view are various play items 104 such as building blocks, books, etc. which can be used for scanning, counting and itemizing when using the subject invention 10.

From reviewing the above description of the subject toy 10 it can be appreciated that a child can easily learn and enjoy using the toy for scanning various items, learn to count and read the number of items scanned when pretending to be a checker at a check out stand. Also, parents of the child can use the toy 10 as a method to train and teach a child to pick up his or her toys in a play room and place them in a toy box or a chosen storage area at the end of a play time, bedtime or recess.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A child's toy capable of being used with one or more play items for playing checker at a check out stand used in retail stores and the like, the toy simulates a bar code reader used for scanning and itemizing various items purchased at a store, the toy comprising:

a housing including a top portion, a bottom portion and side portions;

an on/off switch mounted on the housing;

a power source connected to said housing, said on/off switch electrically connected to said power source;

a first light and a second light mounted in the top portion of said housing and electrically connected to said power source; and an item switch for mechanically engaging play items, said item switch mounted in the top portion of said housing and electrically connected to said power source and said first and second lights such that when said on/off switch is turned "on" said first light is turned "on", and when said item switch is engaged by the play item to be checked said first light is turned "off" and said second light is turned "on" and when said switch is disengaged, said second light is turned off and said first light is turned on again.

2. The toy as described in claim 1 further including a sound means electrically connected to said power source and to said second light, wherein said sound means sounds when said second light is turned "on".

3. The toy as described in claim 2 wherein said sound means is a buzzer.

4. The toy as described in claim 1 further including a counter electrically connected to said power source and to said item switch, whereby said counter counts play items when said item switch is engaged by each play item.

5. The toy as described in claim 1 wherein said power source is a battery power source received inside said housing.

6. The toy as described in claim 1 wherein said first light is a red light and said second light is a green light.

7. The toy as described in claim 1 further including a toy scanning gun connected to said housing, said scanning gun having a barrel and a trigger switch electrically connected to said power source and electrically connected to a simulated scanning light mounted in said barrel of said scanning gun, wherein when said trigger switch is activated said stimulated scanning light is turned on when using said scanning gun for simulating the scanning and checking of toy items.

8. The toy as described in claim 7 further including a second sound means disposed in said scanning gun and electrically connected to said trigger switch and said power source, whereby said second sound means sounds when said trigger switch is activated.

9. The toy as described in claim 7 wherein said scanning gun is releasably attached to said housing and said power source being electrically connected to said trigger switch and said simulated scanning light for operating independently of said housing.

10. The toy as described in claim 8 wherein said second sound means is a buzzer.

11. A child's toy capable of being used with play items for playing checker at a check out stand used in retail stores and the like, the toy simulates a bar code reader used for scanning and itemizing various items purchased at a store, the toy comprising:

a housing including a top portion, a bottom portion and a side portions;

an on/off switch mounted on the housing;

a battery operated power source connected to said housing, said on/off switch electrically connected to said power source;

a red and green light mounted in the top portion of said housing and electrically connected to said power source; and an item switch for mechanical engagement with play items, said item switch mounted in the top portion of said housing and electrically connected to said power source and said red and green lights, such that when said on/off switch is turned "on" said red light is turned "on", and when said item switch is engaged by the play item to be checked said red light is turned "off" and said green light is turned "on" and when said switch is disengaged, said second light is turned off and said first light is turned on again.

12. The toy as described in claim 11 further including a buzzer electrically connected to said power source and to said green light, whereby said buzzer sounds when said green light is turned "on".

13. The toy as described in claim 11 further including a counter electrically connected to said power source and to said item switch, whereby said counter counts play items when said item switch is engaged by each play item.

14. The toy as described in claim 11 wherein said power source is one or more batteries received inside said housing.

15. The toy as described in claim 12 further including a toy scanning gun releasably connected to said housing, said scanning gun having a trigger barrel and a switch electrically connected to said power source and electrically connected to a simulated scanning light mounted in said barrel of said scanning gun, whereby when said trigger switch is activated said simulated scanning light is turned on when using said scanning gun for simulated checking of toy items.

16. The toy as described in claim 15 further including a second buzzer disposed in said scanning gun and electrically connected to said trigger switch and said power source, whereby said second buzzer sounds when said trigger switch is activated.

17. A child's toy capable of being used with play items for playing checker at a check out stand of the type used in retail stores and the like, the toy simulates a bar code reader used for scanning and itemizing various items purchased at a store, the toy comprising:

a housing including a substantially flat top portion, a bottom portion and side portions;

an on/off switch mounted in one of the side portions of said housing;

a power source connected to said housing, said on/off switch electrically connected to said power source;

a red light and a green light mounted in the top portion of said housing and electrically connected to said power source;

an item switch mounted inside said housing and extending upwardly from the top portion of said housing, said item switch electrically connected to said power source and said red and green lights;

at least one ramp means for covering said item switch and engaging play items as they are brushed across a surface of the top portion; and at least one item guide means for guiding play items to be checked over said ramp means as the play items are brushed over a surface of said top portion, whereby when said on/off switch is turned "on" said red light is turned "on", whereby when said ramp means is engaged by a play item said item switch is also engaged by the play item to be checked and said red light is turned "off" and said green light is turned "on";

a buzzer electrically connected to said power source and to said green light, whereby said buzzer sounds when said green light is turned "on"; and a digital counter electrically connected to said power source and to said item switch, whereby said counter counts play items when said item switch is engaged by each play item.

18. The toy as described in claim 17 further including a toy scanning gun releasably connected to said housing, said toy scanning gun having a barrel and a trigger switch electrically connected to the power source and electrically connected to a simulated scanning light mounted in said barrel of said toy scanning gun, whereby when said trigger switch is activated said simulated scanning light is turned on when using said toy scanning gun for simulated checking of toy items.

19. The toy as described in claim 18 further including a second buzzer disposed in said toy scanning gun and electrically connected to said trigger switch, said power source, and said simulated scanning light, whereby said second buzzer sounds when said trigger switch is activated and said simulated scanning light is turned on.

20. The toy as described in claim 18 further including a flexible electrical cord releasably connected to said scanning gun and said power source in said housing for providing power to said scanning gun.

* * * * *